US006540501B1

(12) United States Patent
Bott

(10) Patent No.: US 6,540,501 B1
(45) Date of Patent: Apr. 1, 2003

(54) METHOD AND APPARATUS FOR PRODUCING CONCRETE BLOCKS WITH TEXTURED SURFACES

(75) Inventor: Timothy Allen Bott, Sunfish Lake, MN (US)

(73) Assignee: Allan Block Corporation, Edina, MN (US)

( * ) Notice: Subject to any disclaimer, the term of this patent is extended or adjusted under 35 U.S.C. 154(b) by 27 days.

(21) Appl. No.: 09/717,530

(22) Filed: Nov. 21, 2000

(51) Int. Cl.[7] ..... B28B 11/06

(52) U.S. Cl. ..... 425/385; 425/402; 125/16.01; 125/12; 125/13.01; 264/293; 451/264

(58) Field of Search ..... 52/315, 309, 314, 52/596, 747.12, 749.14, 309.1; 425/402, 385, 403.1, 343; 249/117; 264/333, 162, 293, 310; 51/295, 296; 125/16.01, 16.02, 16.03, 16.04, 12, 13.01, 26, 30.01; 451/261, 262, 264

(56) References Cited

U.S. PATENT DOCUMENTS

| | | | | | |
|---|---|---|---|---|---|
| 1,229,582 | A | * | 6/1917 | Butterworth | 117/10 |
| 1,877,269 | A | | 9/1932 | Colgren | |
| 2,958,163 | A | | 11/1960 | Cammerzell, Jr. | |
| 3,067,731 | A | | 12/1962 | Potter et al. | |
| RE27,109 | E | * | 3/1971 | Videen | 117/10 |
| 3,580,235 | A | | 5/1971 | Lombos et al. | |
| 3,660,214 | A | | 5/1972 | Nichols, Jr. et al. | |
| 3,664,068 | A | | 5/1972 | Metzger et al. | |
| 3,918,210 | A | | 11/1975 | Mori | |
| 4,048,977 | A | | 9/1977 | Jenkins | |
| 4,393,856 | A | | 7/1983 | Gebharg | |
| 4,557,246 | A | | 12/1985 | Seeley | |
| 4,691,684 | A | | 9/1987 | Negron-Crespo | |
| 4,865,887 | A | * | 9/1989 | Virtanen | 427/356 |
| 5,085,008 | A | | 2/1992 | Jennings et al. | |
| 5,133,915 | A | * | 7/1992 | Metten et al. | 264/162 |
| 5,316,465 | A | * | 5/1994 | Hummel | 425/343 |
| 5,492,550 | A | * | 2/1996 | Krishman et al. | 51/298 |
| 5,496,206 | A | | 3/1996 | Young | |
| 5,979,002 | A | * | 11/1999 | Anderson | 15/53.2 |
| 6,109,906 | A | * | 8/2000 | Castonguay et al. | 425/343 |

* cited by examiner

*Primary Examiner*—Jeanette Chapman
(74) *Attorney, Agent, or Firm*—Haugen Law Firm PLLP

(57) ABSTRACT

A method for creating decorative patterns on surfaces of cured concrete blocks includes a plurality of texturing elements secured to one or more rotatable shaft via a plurality of flexible support cables. Upon rotation of the shaft, centrifugal force causes the secured texturing elements to radially extend from the shaft. The blocks are preferably positioned such that the rotating texturing elements repeatedly come into contact with particular surfaces of the blocks, thereby forming a textured or antiqued pattern on such block surfaces. In a particular embodiment, the rotatable shaft is reciprocally moved in a direction parallel to the block surfaces to be patterned, whereby an entire block surface is exposed to the rotating texturing elements.

25 Claims, 9 Drawing Sheets

10
11
12
13
13A
13B
14
14A
17
18
20
22
23
24
27
30
31
35

METHOD AND APPARATUS FOR PRODUCING CONCRETE BLOCKS WITH TEXTURED SURFACES

FIELD OF THE INVENTION

The present invention relates generally to a method and apparatus for creating a decorative textured or antiqued surface on the outer face of cured concrete blocks, and more specifically to such a method and system wherein such a decorative surface is created upon respective block surfaces, some of which blocks may have previously been split to create a randomly textured surface. The method and apparatus of the present invention modifies the textured surface so as to create a textured or antique-appearing surface while at the same time preserving the structural integrity of the remaining surfaces and bulk composition of the block. The finished textured blocks treated in accordance with the present invention are desirable for use in landscaping applications for block walls of substantial height, or in various architectural block applications.

BACKGROUND OF THE INVENTION

In the past, various techniques and systems have been proposed for treatment of concrete blocks in order to create a textured or antique appearance. These techniques include exposure of the block to milling or tumbling operations which have been effected in facilitating and creating such an appearance. Such techniques, while effective, tend to be time consuming and may require additional steps and/or operations in the handling of the blocks prior to such exposure. Additionally, when certain tumbling operations are undertaken, the bulk structure or body of the blocks may be compromised due to exposure to undesirable mechanical forces including shock forces and the like. The method and system of the present invention confines shock exposure to the localized surface being treated, thereby protecting and preserving the structural integrity of the blocks.

Blocks in accordance with the present invention are prepared in accordance with U.S. Pat. Nos. 5,484,263 and 5,623,797, each of which is assigned to the Assignee of the present invention. These blocks are typically prepared with a textured surface resulting from a splitting of a dual block blank along a certain central line to form two blocks with outer surfaces. While these textured surfaces are attractive and useful for a wide variety of applications, the present invention expands the application of these blocks to those arrangements wherein a textured or antique appearance is desired. The block treatment system of the present invention is adapted for use in combination with block conveyors, thereby enabling the process to be undertaken on an in-line basis, without adding or requiring additional handling and/or operational system modifications which would either add or require intermediate stacking and/or curing steps. Thereby such an in-line process renders the system expeditious and efficient, and results in a block appearance which has a desired application in commerce.

Therefore, it is a primary object of the present invention to provide an improved method and apparatus for creating a decorative textured or antiqued surface on an outer face of cured concrete blocks, wherein the textured or antiqued surface is created without compromising or adversely affecting the structural integrity of the block.

A further object of the present invention is to provide an improved system for exposing a concrete block to repeated impact from a plurality of rotating texturing elements, whereby a surface of the block takes on an textured or antiqued appearance, with this appearance being created without adversely affecting the planar surface characteristics of the remaining surfaces of the block.

It is a still further object of the present invention to provide an improved system and apparatus for creating a textured or antiqued surface on concrete blocks, with the system including a block supporting conveyor having an axis of motion for transporting the blocks through a treatment zone in which a plurality of rotary texturing elements are applied to the blocks, wherein the system grippingly engages said blocks while moving the rotating elements along an axis which is parallel to the respective surface to be textured, and with the rotating elements making repeated contact with the block surface for creating a textured or antiqued appearance.

Other and further objects of the present invention will become apparent to those skilled in the art upon a study of the following specification, appended claims, and accompanying drawings.

SUMMARY OF THE INVENTION

In accordance with the present invention, a decorative textured or antiqued surface is created on an outer face of cured concrete blocks by undertaking the steps of initially positioning the blocks to be treated within a treatment zone. While passing through the treatment zone, the blocks exposed to a plurality of texturing elements. Such texturing elements are generally in the form of hardened spheres, with these hardened spheres being secured to a distal end of support cables, which support cables may be flexible. Proximal ends of the cables are in turn secured to one or more support shafts mounted for rotation along a generally vertical axis adjacent to respective surfaces of the blocks to be treated. The support shaft is rotated at a rate sufficient to create a centrifugal force which positions the texturing elements radially outwardly from the shaft, and at a radial extension sufficient to cause the elements to strike the block surfaces. The rotating support shaft is, in turn, mounted within a frame which is moved along an axis parallel to the block surfaces being treated. The centrifugal force generated by rotation or orbital motion of the texturing elements causes the texturing elements to repeatedly impact. respective block surfaces so as to create the forces necessary to texture and/or antique the selected surfaces. Following this operation, the treated blocks are then moved along the support surface, generally a conveyor, to a pallet loading station.

IN THE DRAWINGS

FIG. 1 is a block diagram illustrating certain steps undertaken in the method of the present invention;

FIGS. 2A, 2B, 2C, and 2D are fragmentary top plan views of a portion of the conveyor mechanism and treatment zone, and illustrating a configuration of the operation during a sequence of steps, with these figures further illustrating the steps involved in carrying out an alternative method of the present invention;

PREFERRED EMBODIMENT OF THE PRESENT INVENTION

Figure 1:
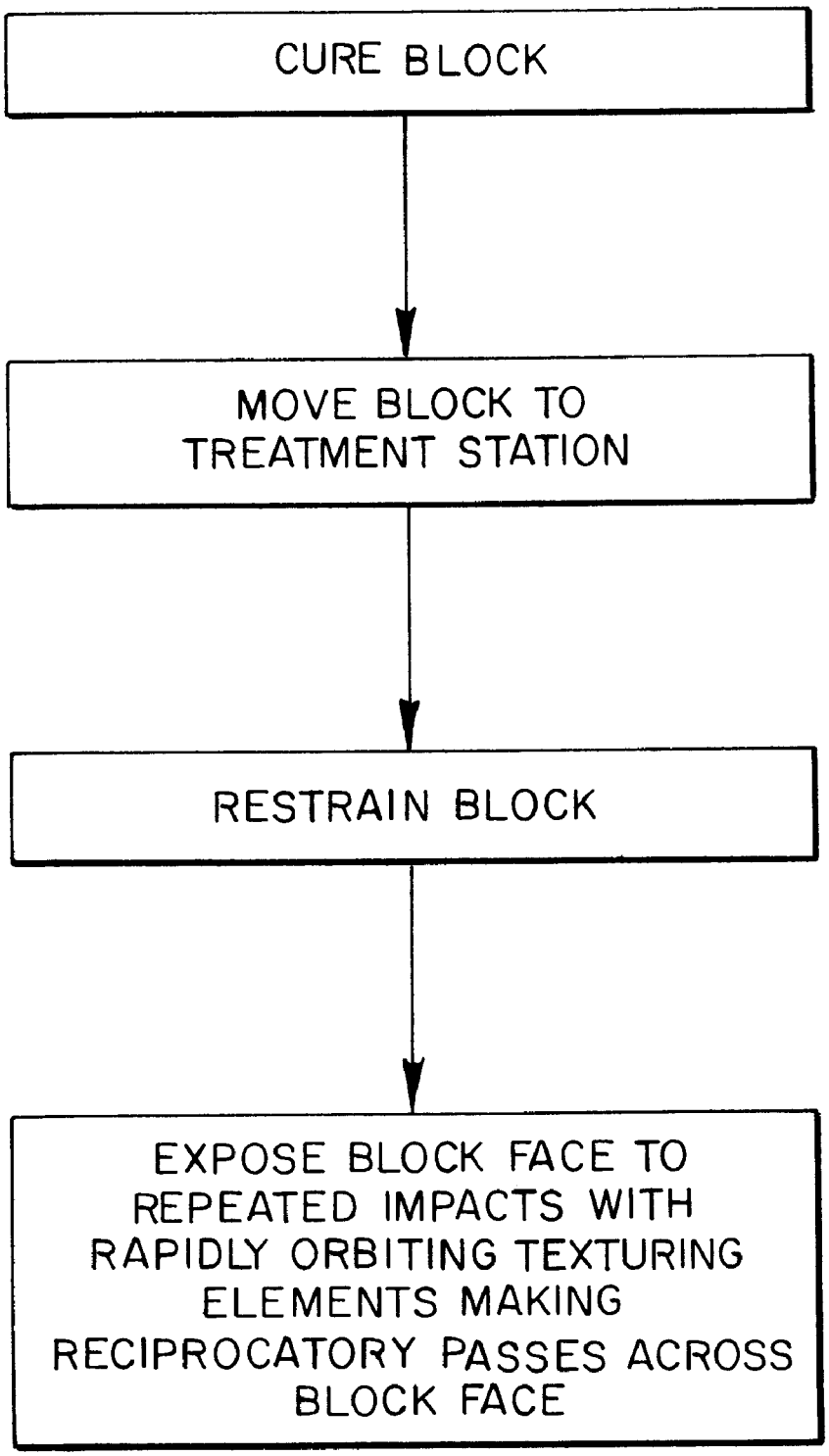
Figure 13:
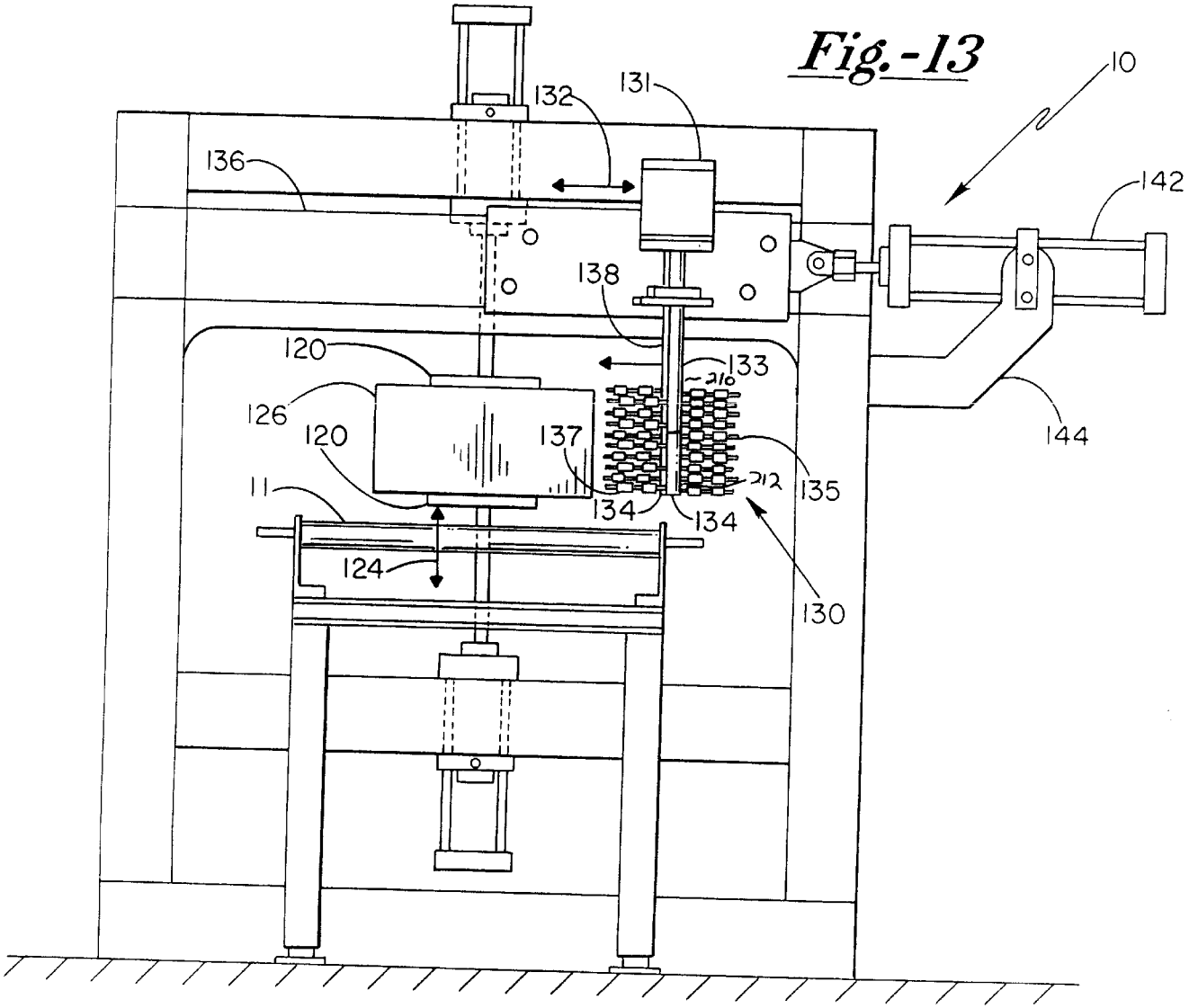
FIG. 13 is a side and elevational view of a preferred embodiment of the invention, wherein the texturing system reciprocally moves in an axis substantially perpendicular to the axis of motion the concrete blocks when the concrete blocks are being conveyed into, and out of the treatment zone.

In accordance with the preferred embodiment of the as present invention, and with particular attention being directed to FIGS. 1 and 13 of the drawings, the apparatus and/or system generally designated 10 includes first and second pairs of block gripping members positioned vertically of a conveyor 11, with the first pair being illustrated at 120-120 (second pair not shown). Such gripping members preferably move reciprocatorally along a vertical axis 124 such that the gripping members contact and grippingly engage respective blocks from above and below the respective blocks. In some embodiments, the gripping members may lift the respective blocks off of conveyor 11. Through such an arrangement, respective block surfaces facing conveyor 11 may also be desirably textured. Respective pairs of gripping members may be adjustingly positioned relative to one another such that the space between respective blocks may be set as desired. Therefore, texturing of respective blocks may be controlled through such adjustment. In preferred embodiments, the blocks may be adjustably gripped relative to one another with an adjusting margin of between about one-eighth inch to two inches.

In accordance with the illustration shown in FIG. 2, a block detector lamp source 17 is shown in operative disposition along conveyor 11, and is designated to detect the presence of a block 126 moving along conveyor 11 toward texturing system 130. Detection of blocks 126 by light detector 17 initiates a gripping sequence by gripping numbers 120-120 and 122-122, such that texturing system 130 is disposed generally midway between a pair of adjacent blocks. Texturing system 130 is mounted on frame means 136 and arranged for reciprocatory motion along an axis illustrated at 132. Texturing system 130 includes a driving means 131, such as an electric motor, and a rotatable shaft 133, upon a distal end 134 of which is mounted a plurality of cable members 135, each of which carries a plurality of texturing elements 137. Such cable members 135 may be fabricated from a durable and generally flexible material such as wound metal, plastics, and other materials. Preferably, cable members 135 one-half inch diameter TOUGH COAT® cable material.

Texturing elements 137 are preferably secured to respective cable members 135, and are arranged to extend radially outwardly upon exertion of a centrifugal force generated by rotation of shaft 133. Texturing elements 137 are typically fabricated of steel, and are preferably fabricated of 4140 steel that is heat treated to Rockwell hardness C55-60. Other materials may be used in place of the steel, such as iron or other materials that are durable and can withstand repeated impacts with the concrete blocks. The texturing elements are preferably spherical in configuration, and typically have a diameter of about 1–2 inches for most typical texturing operations. As the size or configuration of blocks change, or the desired texturing or antiquing pattern changes, it may be desirable to utilize texturing elements of somewhat larger diameter or weight in order to achieve the desired aesthetic effect.

Shaft 133 is rotated at a rate which is dependent upon desired texturing and respective block materials, with this velocity being generally sufficient to create the texturing effect on cured concrete blocks. In typical applications, shaft 133 is rotated at a rate of between 300–1200 rpm. Such rotational speed is preferably sufficient to negate undesirable effects such as texturing inconsistencies caused by texturing element impacts and shaft reciprocatory motion. In some embodiments, more than one shaft 133 may be utilized to texture respective blocks (as designated at 138), and such multiple shafts may be rotated in relatively different rotational directions, and along relatively distinct axes. In other embodiments, a first portion 210 of shaft 133 may rotate in a counter-clockwise direction, while a second portion 212 of shaft 133 may rotate in a clockwise direction.

In addition to the rotary motion of the texturing system, reciprocatory motion is also provided, as illustrated by motion axes designated at 132. Reciprocatory motion is achieved by moving texturing system 130 reciprocatorally along frame means 136, in that texturing system 130 is preferably designed slidable motion along frame means 136. A dual axis hydraulic cylinder such as is illustrated at 142 may be utilized to provide the reciprocatory motion of texturing system 130. Bracket or stabilizing arm 144, provided with appropriate strength and rigidity, is utilized to guide and stabilize the reciprocatory motion of texturing system 130. The reciprocatory motion of texturing system 130 preferably provided a speed of from about one foot per second to about three feet per second, and may be correspondingly adjusted to provide desired texturing characteristics to respective blocks 126.

In preferred embodiments, shaft 133 is rotated by a chain-driven motor, such that rotational speed may be easily adjusted. Varying rotational speeds desirably results in uneven, "natural" looking surfaces. Such a "natural" appearance may also be advantageously achieved by the desired reciprocatory motion of shaft 133 along the respective block face to be textured, as well as multiple shafts 133 rotating in opposite directions, and reciprocating along respective block faces. The reciprocatory nature of the present invention provides additional angles of texturing element impacts with respective block surfaces, thereby limiting a "patterned" appearance to such surfaces. Such desired effects are also enabled by counter-rotating texturing elements as the elements reciprocate along respective block surfaces.

Figure 14:
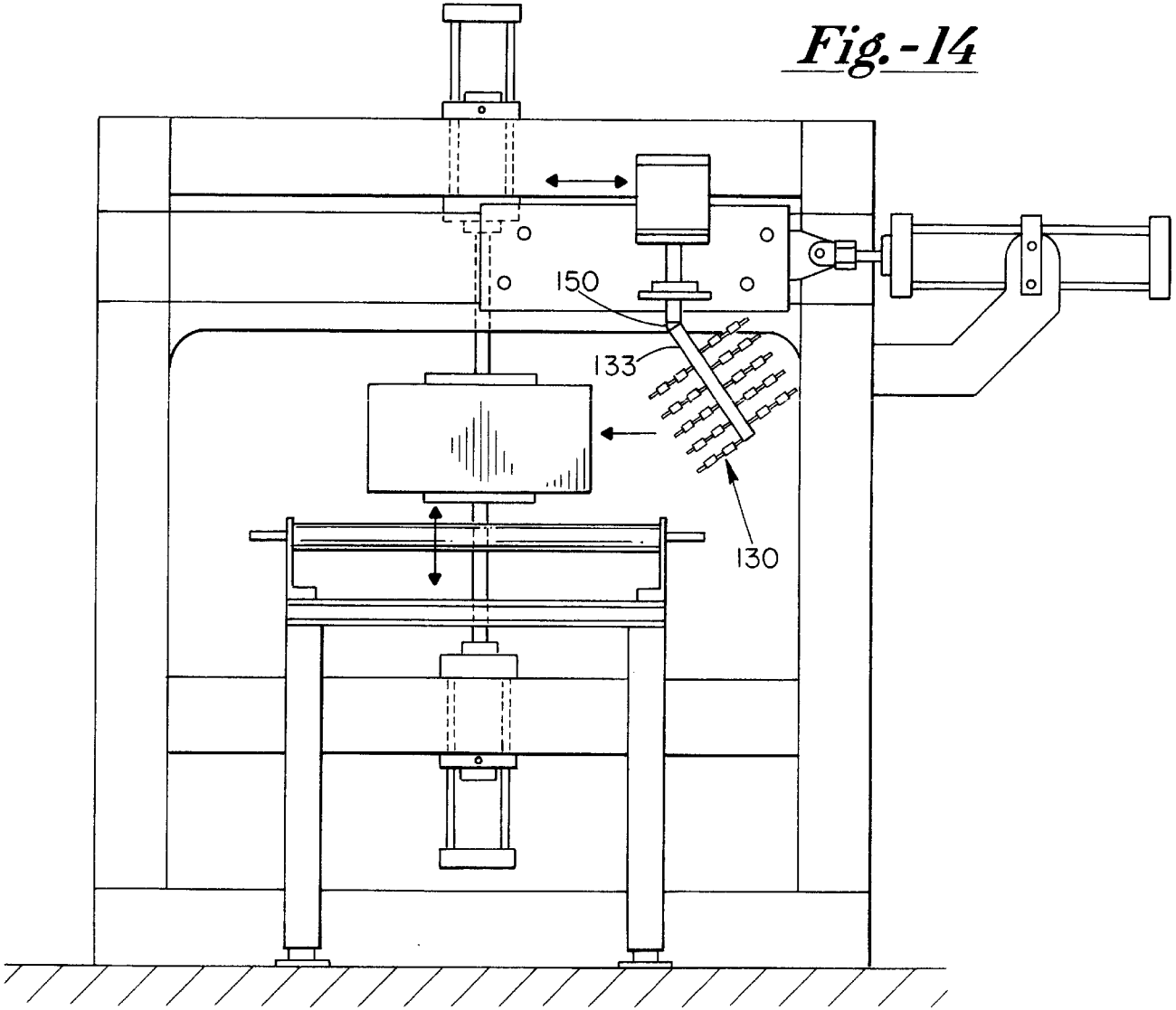
FIG. 14 is a side and elevational view of a preferred embodiment of the present invention which is similar to the embodiment shown in FIG. 13, with the addition of a universal-type joint in the rotatable axis of the texturing system, thereby allowing angular rotation of the texturing system.
Figure 15:
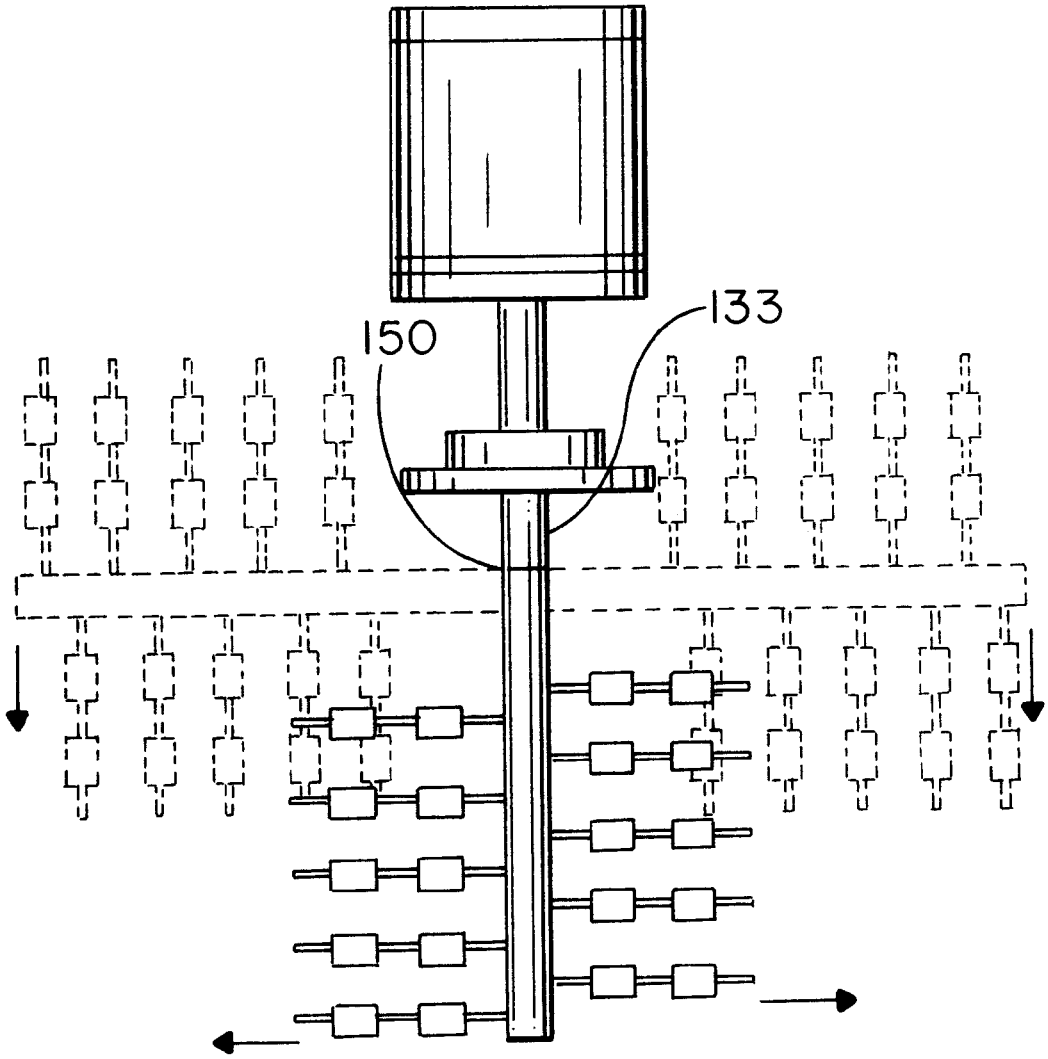
FIG. 15 is an enlarged view of a texturing system shown in FIG. 14.

In a particular embodiment of the present invention, as illustrated in FIG. 14, texturing system 130 may be provided the universal-type joint 150 in shaft 133. Such a pivoting joint 150 allows for angled texturing element impact with respect to blocks 126, thereby providing a variety of texturing characteristics. Such pivoting action is shown in greater detail in the enlarged illustration of texturing system 130 in FIG. 15. Pivot joint 150 preferably allows shaft 133 to be angled at any desired disposition, thus utilizing three-dimensional pivoting.

As shown in FIG. 2, an alternative embodiment of the present invention includes a conveyor having an upper block supporting flight 11 upon which are positioned and/or disposed a plurality of cured concrete blocks as shown at 12, 13, and 14. Additionally, and in accordance with the illustration shown in FIG. 2, a block detector lamp source 17 is shown in operative disposition along the conveyor, and being designed to detect the presence of a block moving along the belt 11 in and along the direction of motion axis arrow 18. In one embodiment of the present invention, first and second pairs of block gripping members are also positioned laterally of the conveyor, with the first pair being illustrated at 20-20, and with the second pair being illustrated at 22-22. These gripping members are designed to move reciprocatorially along an axis transverse to motion axis 18, and with end pads such as at 23-23 and 24-24 being disposed and arranged to contact and grippingly engage and/or restrain individual blocks from forward motion along the conveyor.

Figures 2A, 2B, 2C, 2D:
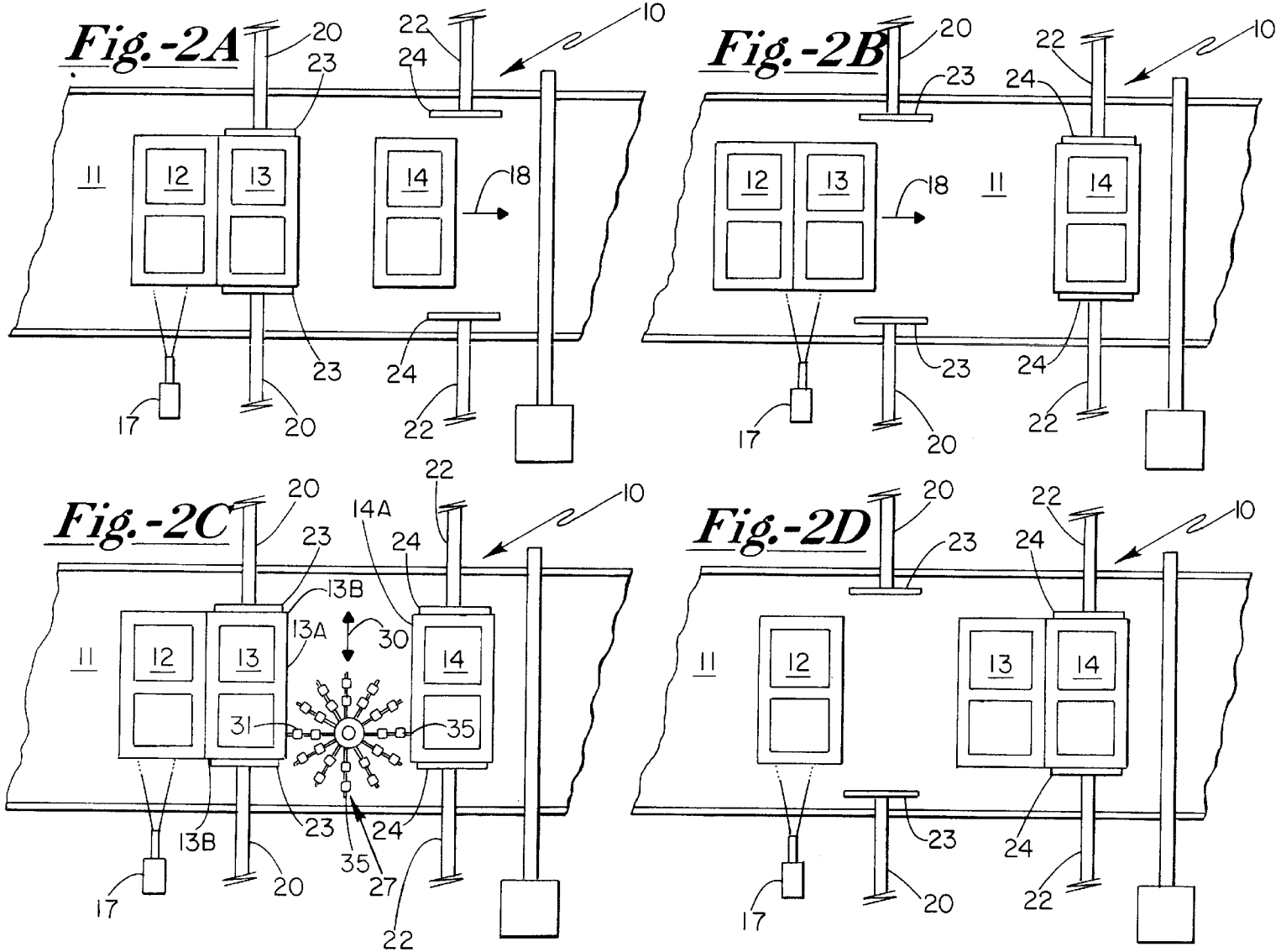
Figure 3:
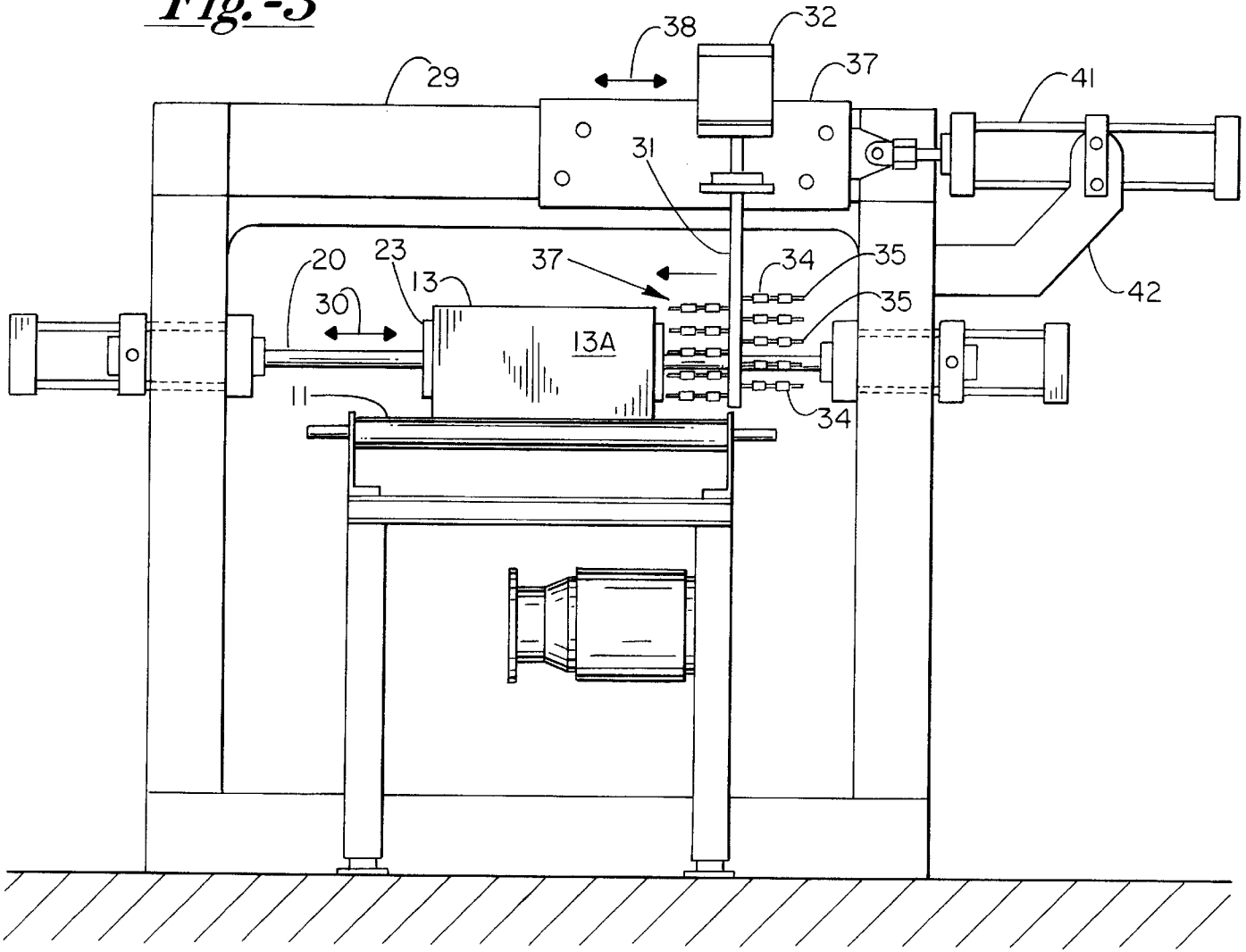
FIG. 3 is a side and elevational view of the conveyor and texturing mechanisms of the embodiment shown in FIG. 2, and illustrating the position of a typical block undergoing the texturing operation in the treatment zone.

With attention being directed to FIG. 2C, it will be observed that the surface texturing arrangement generally designated 27 is disposed generally midway between a pair of adjacent blocks such as blocks 13 and 14. Texturing system 27 is mounted on frame means as at 29 (see FIG. 3) and arranged for reciprocatory motion along the axis illustrated at 30. The distal tip end of system 27 includes one or more rotary shafts as at 31 which may be appropriately mounted within frame 29 and driven by motor 32, and carrying a plurality of cable members 35-35, each of which carries a plurality of texturing elements.

With attention now being redirected to FIGS. 2A–2D inclusive, a typical operation will be explained. In FIG. 2A, blocks 12, 13 and 14 are moving along a longitudinal axis and in the direction of arrow 18, as each block passes a detector 17. Detector 17 functionally controls the reciprocatory motion of restraining pads 20-20 and 22-22, and accordingly grips and restrains block 13 while block 14 continues to move. Upon reaching its position along flight 11, grippers 22-22 are set into motion to restrain block 14 from further motion. Texturing assembly 27 is energized, with shaft 31 rotating at a velocity sufficient to extend texturing elements 34-34 radially outwardly and in contact with the surface of blocks 13 and 14. Assembly 27 is then moved reciprocatorially along the direction of double-ended arrow 30 so as to cause contact between the texturing elements and the faces of 13A and 14A of blocks 13 and 14 respectively. This motion not only textures or antiques surfaces 13A and 14A, but also provides a breaking radius at the corners of the individual blocks such as at 13B, for example.

For texturing applications, it is, of course, necessary that there be impact between the texturing elements and the block surface before reaching the tangent or dead-center line. For typical applications, experience has demonstrated that an angle of attack of approximately 40 degrees between the block surface and the texturing elements is desired. In certain applications, this angle may range from between about 20 degrees and 60 degrees, with this range having been found suitable for most texturing and/or antiquing operations.

A total of one reciprocatory excursion with two shafts 31, or two excursions with one shaft 31 will typically be undertaken by system 27 while blocks 13 and 14 are restrained in place by reciprocating arms 20-20 and 22-22. Following the operation illustrated in FIG. 2C, arms 20-20 are recessed and block 13 is moved adjacent block to 14 and subsequently reciprocating pads from arms 22-22 are released, thereby permitting blocks 13 and 14 to continue their travel along supporting surface of conveyor flight 11.

Figure 11:
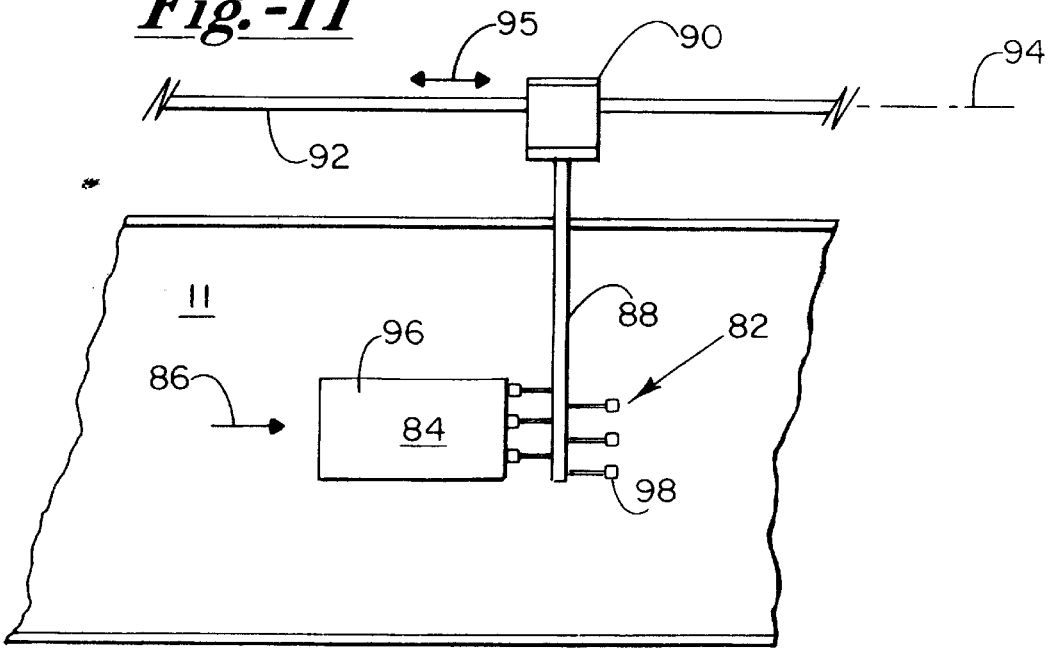
FIG. 11 is a top view of an alternative embodiment of the present invention, wherein the texturing system is suspended vertically above the concrete blocks to be textured, and reciprocally moves in an axis generally parallel to the axis' motion of the concrete blocks on the powered conveyor.

An additional embodiment of the present invention is shown at FIG. 11, wherein an overhead rotating texturing system 82 is shown disposed above a concrete block 84, which block is positioned upon a movable conveyor 11 generally moving in the direction of motion arrows designated at 86. Texturing system 82 is preferably connected to a rotatable extension arm 88, which rotatable arm 88 is operably connected to motor 90. In preferred embodiments, motor 90 powers a chain drive, which chain drive rotates arm 88. The combination motor/rotatable arm is preferably movable along support rail 92 along an axis illustrated at 94 along motion arrow 95.

Figure 12:
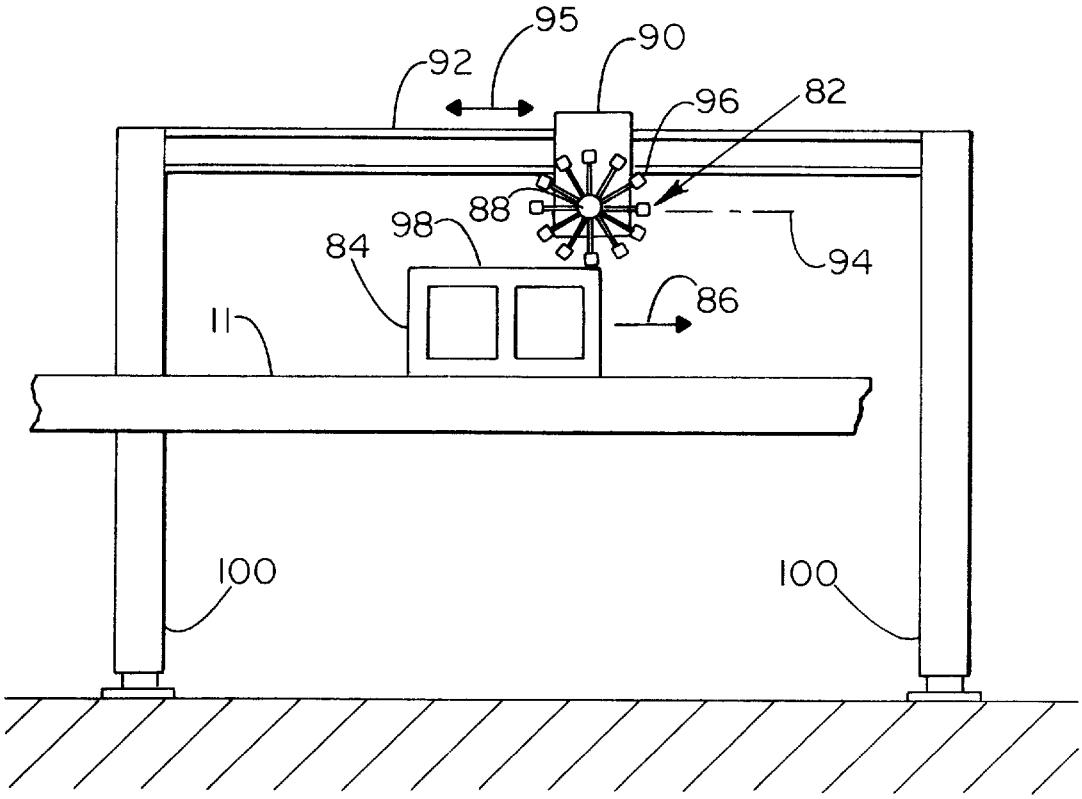
FIG. 12 is a side view of the embodiment shown in FIG. 10.

A side view illustrating the apparatus of FIG. 11 is depicted in FIG. 12. As shown in FIG. 12, texturing system 82 is oriented such that upon rotation, texturing element 96 generally extend in a vertical plane substantially perpendicular to texturing or antiquing surface 98 of block 84. As block 84 is moved along conveyor 11 in the direction of arrow 86, energized texturing system 82 is reciprocatorally moved along axis 94, which axis 94 is generally parallel to the direction of motion of block 84. Such reciprocatory motion is brought about by reciprocating means operably coupled to the combination of motor 90, rotatable arm 88, and texturing system 82. In some embodiments, block 84 may be held by gripping means (not shown) while texturing system 82 textures block 84. As shown in FIG. 11, support rail 92 is itself supported by a plurality of support posts 100.

In the alternative embodiment shown in FIGS. 11–12, a means for varying the rate in which texturing systems 68 and 82 move along longitudinal axes 70 and 94 respectively is desired. Because the systems illustrated in FIGS. 11–12 provide for continuous motion of the blocks along conveyor 11, the respective texturing systems 68, 82 preferably move relatively slower when moving in a direction generally opposite of the respective blocks, motion, and relatively faster when moving in generally the same direction as the respective blocks. In doing so, the relative differential rate between the respective texturing systems and the respective blocks to be textured is substantially similar throughout the texturing process. Such variable speed reciprocating motion means may be enabled through a variety of means. One such means, for example, includes a two speed reciprocator device, wherein a drive pin, fastened to a chain, rides in a vertical slot to reciprocate a carriage in a horizontal direction. Velocity in both directions is constant and depends on the angle of slope that the chain makes with the vertical slot. As the drive pin is moved with the chain in a horizontal direction, velocity is, for example, "x". As the reciprocating chain moves at an angle toward a starting point, the drive pin moves with a velocity, "y", which velocity "y" is greater than velocity "x". An example of such a two-speed reciprocator device is illustrated and described on page 78 of "Mechanisms and Mechanical Devices Source Book" by Nicholas P. Chironis, published in 1991 by McGraw-Hill, Inc. Other multi-speed reciprocating engines may also be utilized to perform the desired dual-speed texturing action.

In a particularly preferred embodiment, conveyor 11 moves with speed "a". To obtain the desired texturing or antiquing results, a respective texturing system having a reciprocating velocity "b" in a direction opposite conveyor velocity "a" has a reciprocating velocity "b" plus "a" in the direction of conveyor velocity "a".

Figure 4:
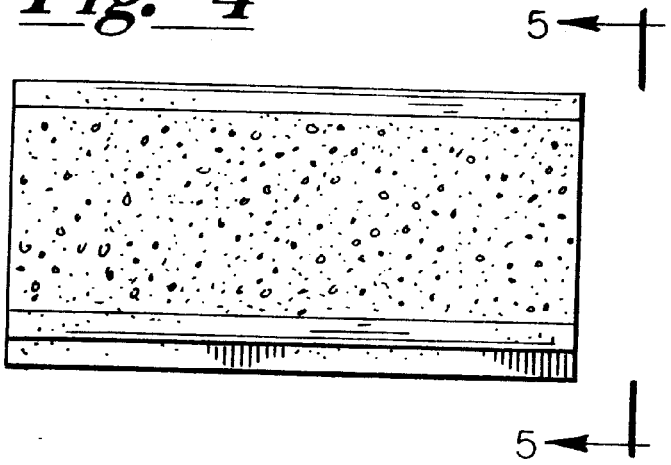
FIG. 4 is a front elevational view of a typical concrete block prior to the texturing or antiquing operation.
Figure 5:
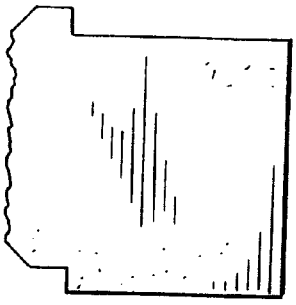
FIG. 5 is a end view taken along the line and in the direction of the arrows 5—5 of FIG. 4.

With attention now being directed to FIGS. 4 and 5, this view illustrates the configuration of a block surface following splitting or processing but prior to the texturing or antiquing operation. It will be observed that the surface topography as illustrated in FIG. 5 may be created by appropriate splitting of a dual block, and is illustrated in U.S. Pat. No. 5,484,236, referred to hereinabove.

Figure 6:
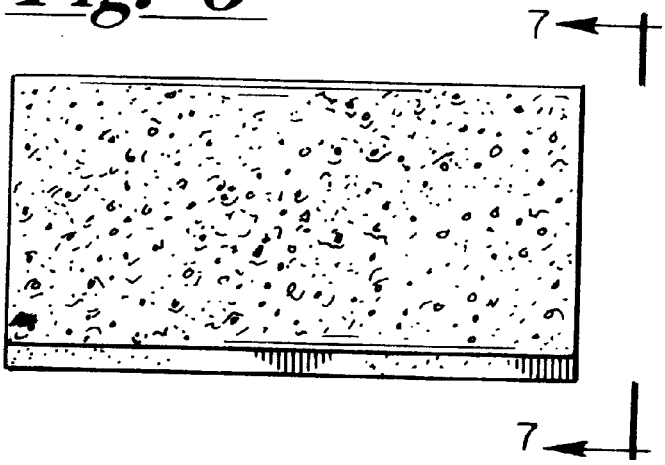
FIG. 6 is a front elevational view similar to FIG. 4 and illustrating the configuration of the appearance of the front surface of the block following the texturing or antiquing operation.
Figure 7:
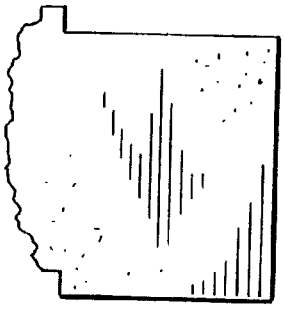
FIG. 7 is a end view taken along the line and in the direction of the arrows 7—7 of FIG. 6.

With attention being directed to FIGS. 6 and 7, it will be observed that the surface topography becomes much finer than that illustrated in FIGS. 4 and 5, with this being due to the texturing operation as described hereinabove. Exposure to repeated impact with the texturing elements is responsible for this modification of such a textured surface and appearance.

Figure 8:
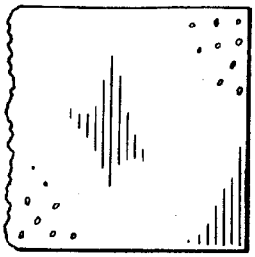
FIG. 8 is an end view of an alternative configuration of a block following the texturing operation.
Figure 9:
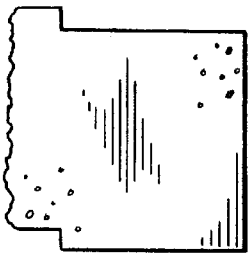
FIG. 9 is an end view of an alternative configuration of a block following the texturing operation.

FIGS. 8 and 9 illustrate alternative configurations of the textured concrete blocks.

Figure 10:
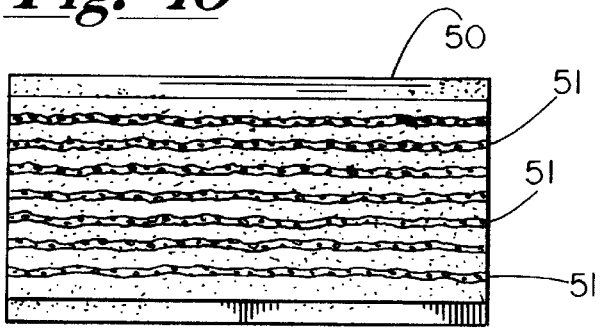
FIG. 10 is a view similar to FIG. 6 and illustrating the appearance of a block subjected to the texturing operations of the present invention to create a plurality of generally horizontally extending grooves.

With attention now being directed to FIG. 10 of the drawings, it will be observed that block 50 is provided with a series of horizontally extending grooves as at 51-51. These grooves may typically be formed by the utilization of small rapidly rotating texturing elements which form a groove along the block face, with the depth of the grooves being determined by the number of reciprocatory excursions of the texturing system. In some embodiments, only one or a few such grooves are on the respective block surfaces.

It will be appreciated that the surface treatment system of the present invention provides a efficient and effective means of texturing, antiquing, grooving, or otherwise modifying the surface of a concrete block with this treatment being undertaken and completed without adversely effecting the physical properties of the block per se.

It will be further appreciated that various modifications may be made from the specific examples given herein without departing from the spirit and scope of the present invention.

What is claimed is:

1. The method of creating a decorative textured surface on an outer face of cured concrete block comprising the steps of:

(a) positioning a block having a surface to be textured in a treatment zone;

(b) securing one or more texturing elements to a distal end of a support cable, with a,proximal end of said support cable being secured to a support shaft mounted for rotation along an axis;

(c) rotating said support shaft at a rate sufficient to extend said texturing elements radially outwardly through centrifugal force;

(d) reciprocally moving said rotary support shaft along a generally horizontal axis substantially parallel to the surface to be textured whereby the centrifugal force causes said texturing elements to repeatedly impact the block surface to be textured.

2. The method of claim 1 wherein the texturing impact action of said texturing elements is simultaneously applied to respective surfaces of at least two blocks.

3. The method of claim 1 wherein the shaft rotating rate is adjustably controlled.

4. The method of claim 1, including an automated means for securing the blocks in said treatment zone.

5. The method of claim 4 wherein said securing means includes a sensing means for detecting the presence of blocks in said treatment zone, said sensing means being operably coupled to a gripping means for holding said blocks in place, whereby said sensing means initiate said gripping means when particular blocks are detected.

6. The method of claim 1 wherein said texturing elements are adapted to impart grooves in said block.

7. A method of creating decorative patterns on outer surfaces of cured concrete blocks, comprising:

(a) positioning the concrete blocks on a movable support structure;

(b) transporting the blocks to a treatment zone via said movable support structure, said treatment zone including a rotary support shaft having a plurality of texturing elements flexibly secured thereto;

(c) securing one or more blocks within said treatment zone such that particular block surfaces to be decorated are in contact with rotating said rotatable texturing elements;

(d) rotating said support shaft at a rate sufficient to extend said texturing elements radially outwardly through centrifugal force; and (e) reciprocally moving said rotary support shaft along a direction parallel to such block surfaces such that a desired decorative pattern on the surfaces is achieved by a plurality of impacts between said texturing elements and such block surfaces.

8. A method as in claim 7 wherein said texturing elements simultaneously impact respective surfaces of at least two such blocks.

9. A method as in claim 7 wherein said texturing elements are secured to distal ends of flexible support cables, which support cables are secured to said rotary support shaft at proximal ends of respective said cables.

10. A method as in claim 9 wherein said rotary support shaft rotates in a generally vertical axis.

11. A method as in claim 10 wherein a first portion of said rotary support shaft rotates in a clockwise direction, and a second portion of said rotary support shaft rotates in a counter-clockwise direction, such that some of said texturing elements rotate in a clockwise direction while other said texturing elements rotate in a counter-clockwise direction.

12. A method as in claim 10 wherein said rotary support shaft is reciprocally moved along a generally horizontal axis substantially perpendicular to the direction of motion of said movable support structure.

13. A method as in claim 9 wherein said rotatable shaft includes a pivot such that a distal portion of said shaft may rotate at an angle with respect to a proximal portion of said shaft.

14. A method as in claim 7, including automated means for securing the blocks in said treatment zone.

15. A method as in claim 14 wherein said securing means includes a sensing means for detecting the presence of blocks in said treatment zone, said sensing means being operably coupled to gripping means for holding said blocks in place, whereby said sensing means initiate said gripping means when particular blocks are detected.

16. A method as in claim 15 wherein said gripping means reciprocatorally move along a substantially vertical axis to grippingly engage respective blocks.

17. A method as in claim 16 wherein said gripping means lift respective blocks off of said movable support structure.

18. A method as in claim 10 wherein said rotary support shaft is reciprocally moved along a generally horizontal axis parallel to the motion of said movable support structure.

19. A method as in claim 18 wherein said concrete blocks move continuously through said treatment zone.

20. A method as in claim 9 wherein said rotary support shaft rotates in a generally horizontal axis.

21. A method as in claim 20 wherein said rotary support shaft is reciprocally moved along a generally horizontal axis parallel to the motion of said movable support structure.

22. A method as in claim 21 wherein said texturing elements rotate in a generally vertical plane.

23. A method as in claim 18 wherein the rotary support shaft reciprocal movement is relatively slower when moving in an opposite direction of the block motion, and relatively faster when moving in substantially the same direction of the block motion, such that relative speed between said rotary support shaft and the respective block surfaces is substantially constant.

24. A method as in claim 21 wherein the rotary support shaft reciprocal movement is relatively slower when moving in an opposite direction of the block motion, and relatively faster when moving in substantially the same direction of the block motion, such that relative speed between said rotary support shaft and the respective block surfaces is substantially constant.

25. A method as in claim 9 wherein said support cables are secured to respective ones of multiple rotary support shafts.

* * * * *